United States Patent [19]

Hansel

[11] 4,071,059

[45] Jan. 31, 1978

[54] PROGRAMMABLE MANUAL ACTUATOR

[75] Inventor: William B. Hansel, Media, Pa.

[73] Assignee: Suntech, Inc., Wayne, Pa.

[21] Appl. No.: 719,019

[22] Filed: Aug. 30, 1976

Related U.S. Application Data

[63] Continuation-in-part of Ser. No. 672,580, April 1, 1976.

[51] Int. Cl.[2] ..... B65B 3/26

[52] U.S. Cl. ..... 141/206; 141/392

[58] Field of Search ..... 141/392, 206–229, 141/37–61

[56] References Cited

U.S. PATENT DOCUMENTS 3,996,979 12/1976 Barr et al. ..... 414/392

*Primary Examiner*—Houston S. Bell

*Attorney, Agent, or Firm*—J. Edward Hess; Donald R. Johnson; Paul Lipsitz

[57] ABSTRACT

A control system for a gasoline dispensing nozzle which includes a locking system for placing the nozzle in an inoperative mode once the nozzle automatically shuts off. Resetting of the locking system is then required before operation of the nozzle can again be commenced. The locking system includes a biased member which maintains the automatic shut-off system in its disabling mode once it disables the nozzle. This locking system is designed primarily for use on a dispensing nozzle with a vapor receiving system and is used to discourage an operator of the nozzle from overfilling a gasoline tank, which results in increasing the risk of spilling gasoline or forcing gasoline back through the vapor return line. An alternative embodiment using magnetic locking means is also provided.

An actuator for the resetting operation is also provided for limiting the number of times the locking system can be reset during each filling operation.

26 Claims, 20 Drawing Figures

FIG.3.
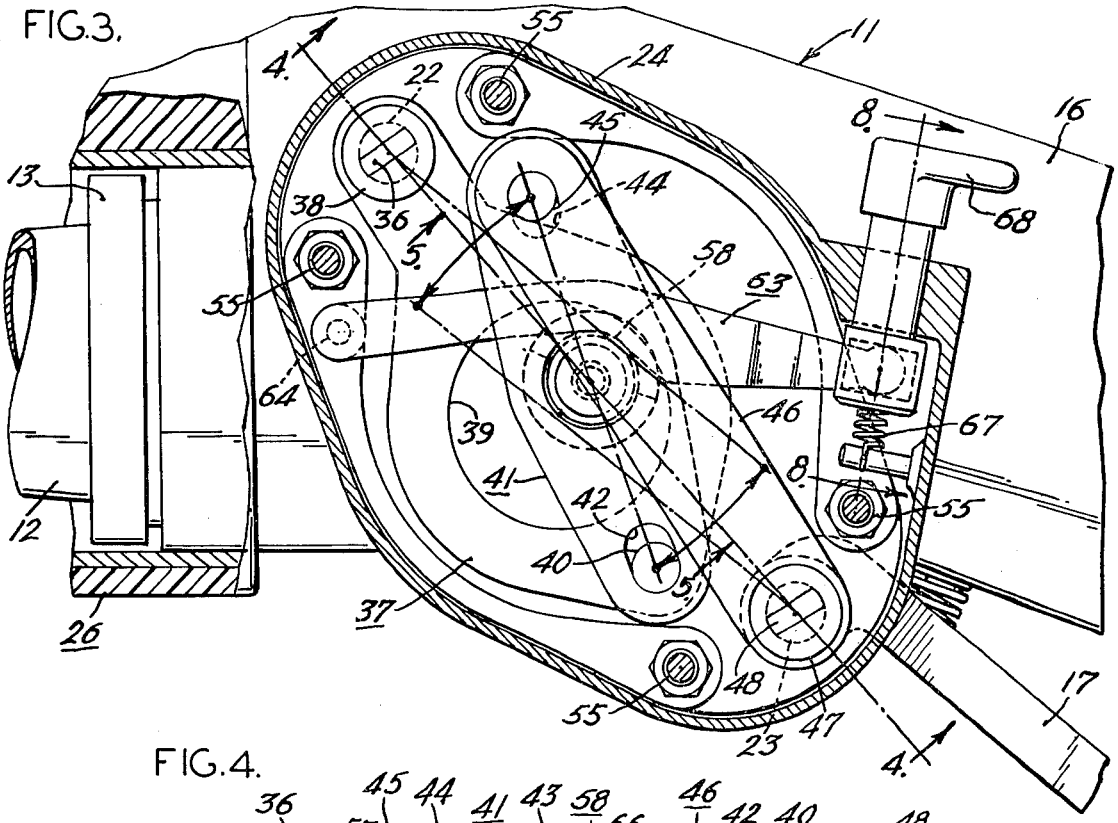
FIG.4.
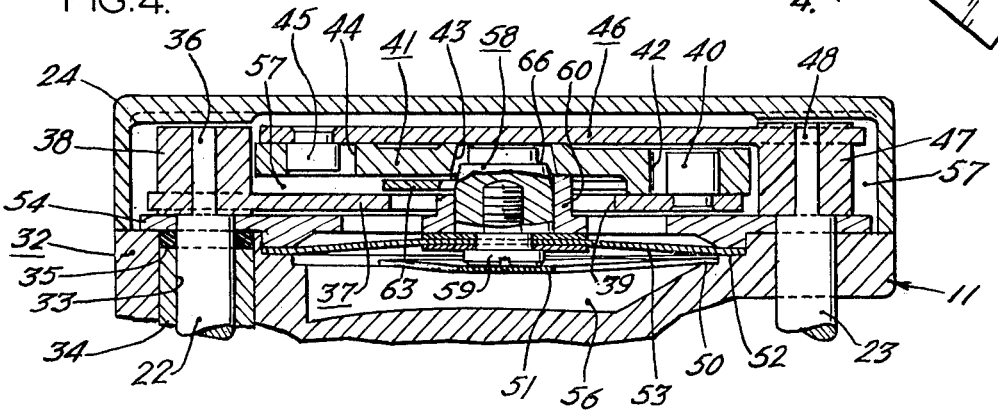
FIG.5.
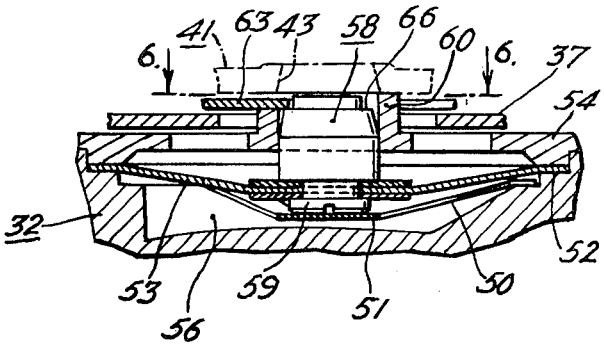
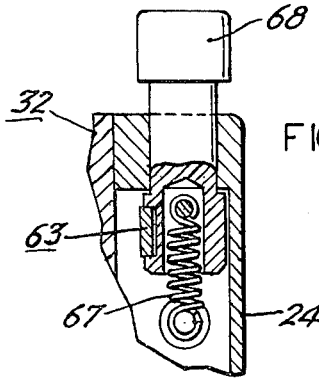
FIG.8.

PROGRAMMABLE MANUAL ACTUATOR

CROSS-REFERENCE TO RELATED APPLICATIONS

This application is a continuation-in-part of a copending application entitled "Dispensing Nozzle Control System," Ser. No. 672,580, filed Apr. 1, 1976, wherein the additional subject matter in this continuation-in-part relates to an actuator for resetting the locking mechanism a predetermined number of times.

BACKGROUND OF THE INVENTION

This invention relates to nozzles for dispensing gasoline into vehicle fuel tanks and more specifically to systems for controlling the operation of a dispensing nozzle having a vapor receiving system.

Current environmental regulations require in some areas that gasoline vapors displaced from a vehicle fuel tank while being filled are to be recovered in order to prevent their escape into the atmosphere. One method of complying with this requirement is to have a closed filling system wherein the vapors displaced from the fuel tank are forced back into the underground hydrocarbon storage tanks. Many systems have been designed to recover vapors by this direct displacement method. Most of them include a vapor receiving system surrounding the discharge spout of the nozzle which has a sealing face for making a tight seal against the fillpipe opening and an outlet which is connected to the underground tanks so that the vapors are displaced into the vapor receiving system and back through the vapor return line to the underground tanks. A second system for collecting the vapors is a vacuum assist system which utilizes a vacuum pump in the vapor return line to assist the flow of vapors into the underground tank or other collection facility.

One problem that has arisen in the use of these vapor receiving systems is that once the vehicle fuel tank becomes filled, the dispensing nozzle automatically shuts itself off, the operator often tries to fill the tank further. These attempts may result in gasoline being pumped back into the vapor receiving system and back to the background tanks through the vapor return line. This recycling of the gasoline can result in the customer buying more gasoline than he has actually received and maybe even more than the tank in his vehicle can hold. In addition, leakage of gasoline out through the seal of the vapor receiving system with the fillpipe can increase the risk of fire. Another problem is that the efficiency of vapor recovery is decreased if liquid gasoline is in the vapor return line.

Understanding the reason behind this problem requires an understanding of the operation of the automatic shut-off system used in most nozzles commercially available today. The shut-off system utilizes the pressure differential between two pressure chambers to create a differential displacement of a flexible diaphragm separating the two chambers. The position of this diaphragm determines whether or not the actuating lever which is moved to open the main valve of the nozzle, is able to actuate the main valve. In operation, when the pressure in a first chamber falls below a predetermined level, the diaphragm displacement disables the actuating lever so that it can no longer open the main nozzle valve.

The reduced pressure in the first chamber is achieved by having it connected to a vacuum source such as a venturi arrangement in which the vacuum is created by the flow of gasoline through the venturi. As is known by those skilled in the art, this vacuum is relieved through a vent line connected to this first chamber at one end and at the end of the discharge spout at the other end. When the liquid level reaches the end of the spout, the vent tube outlet is covered and the vacuum caused by the venturi cannot be relieved, so the diaphragm is displaced to cause the main valve to close.

However, if the operator desires, he can attempt dispensing of gasoline again since the diaphragm returned back to its normal position when the flow of gasoline stopped because the automatic shut-off system has an inherent time delay before disabling the nozzle again due to the fact that the required vacuum force from the flow of gasoline through the venturi must be created again. Thus, the operator can initiate gasoline dispensing ad infinitum, causing a certain amount of gasoline to be pumped into the tank each time.

When using a vapor receiving system with the dispensing nozzle, the operator cannot visually ascertain the liquid level in the tank. Therefore, with further attempts to "top off" the tank, a point is reached where gasoline is pumped into the vapor receiving system.

SUMMARY OF THE INVENTION

In accordance with a preferred embodiment, a locking system is provided which operates in conjunction with the control system for a gasoline dispensing nozzle to prevent further dispensing of gasoline after the nozzle has automatically shut itself off. The locking mechanism is designed to preferably be used on most conventional nozzles available today, having a nozzle control system which includes a nozzle valve actuation system for opening and closing the nozzle valve, and an automatic shut-off system operating in response to the liquid level in the container being filled to disable the actuation system so that the nozzle valve closes. The locking mechanism is designed to lock the automatic shut-off mechanism in its disabling position when that position is obtained. A reset mechanism is provided to release the locking mechanism to again enable the actuation system so that further dispensing of gasoline can be commenced. Preferably, the reset mechanism is located in such a position as to make it inconvenient for the operator to continually reset the locking mechanism, so as to discourage excessive attempts to "top off" the tank.

An alternative embodiment utilizes a magnetic means for maintaining the automatic shut-off mechanism in its disabling position when that position is obtained as well as reset means to release the magnetic means.

In order for the operator to top off the tank, he will have to reset the locking mechanism after each time the automatic shut-off system disables the nozzle. Assuming proper instructions to the operator and compliance by the operator, the possibility of the operator overfilling the tank is minimized, as well as the possibility of gasoline being pumped back into the vapor receiving system. The resulting benefits include accurate determination of the quantity of gasoline received by the customer and maintenance of the vapor receiving system in its proper condition.

While the locking mechanism by itself should be a sufficient incentive to encourage proper filling of a tank, a programable reset actuator is also provided for limiting the number of times the locking mechanism can be reset. The actuator includes a driving element and a driven element arranged so that the driving element will displace the driven element only when a predetermined number of balls is located between the two elements. The actuator structure is designed so that once the driven element is displaced by the driving element, a ball is moved out of position between the two elements. When all the balls have been displaced out of position, the driven element can no longer be displaced by moving the driving element. However, once the position of the actuator structure has been rotated through a predetermined arc and back, such as by inserting the nozzle back into the pump housing and returning it to a position for dispensing, the balls return to the position between the driven and driving elements. The number of balls used determines the number of times the operator can reset the locking mechanism.

If an actuator having two balls enclosed therein is used, the nozzle could be reset upon insertion into the fillpipe to enable dispensing of gasoline, and when the nozzle automatically shuts itself off, a second reset is permitted. After the next shut off, no more dispensing is permitted until the nozzle is placed in an upward position first.

DESCRIPTION OF THE DRAWINGS AND PREFERRED EMBODIMENT

FIG. 3 is a sectional view taken through the nozzle control system. (Some of the hidden detail has been eliminated to avoid unnecessarily complicating the drawing).

FIG. 4 is a sectional view taken along the lines 4—4 in FIG. 3.

FIG. 5 is a sectional view of FIG. 3 along the line 5—5 illustrating the locking system in its locked position.

FIG. 8 is a detailed view of the reset mechanism.

THE DISPENSING NOZZLE

For purposes of illustrating the preferred embodiment of this invention, a dispensing nozzle with a design similar to that illustrated in U.S. Pat. No. 3,734,339 issued to E. T. Young, and a vapor receiving system similar to that disclosed in a copending patent application entitled "Gasoline Dispensing Nozzle With A Vapor Receiving System," by Hansel, filed Sept. 2, 1975, Ser. No. 609,761 will be used.

Figure 1:
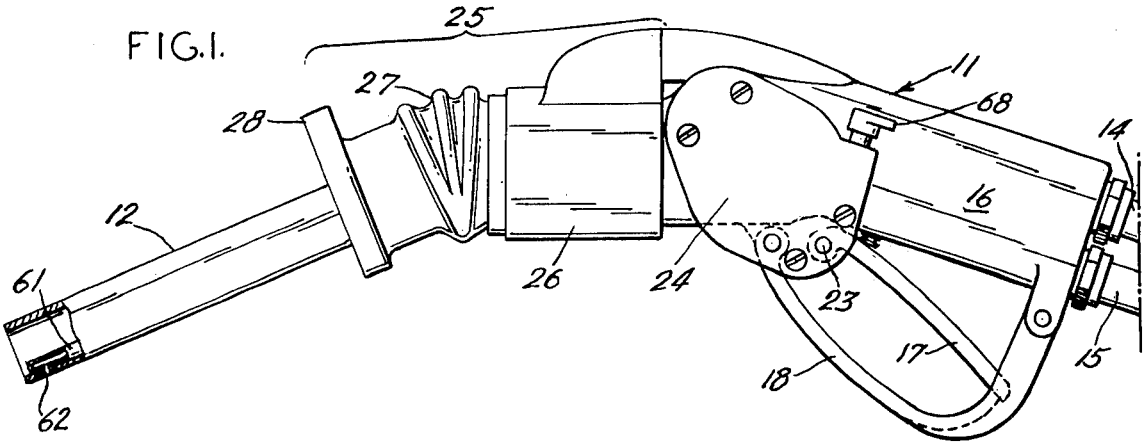
FIG. 1 is a view of a typical dispensing nozzle with a vapor receiving system illustrating its external appearance.
Figure 2:
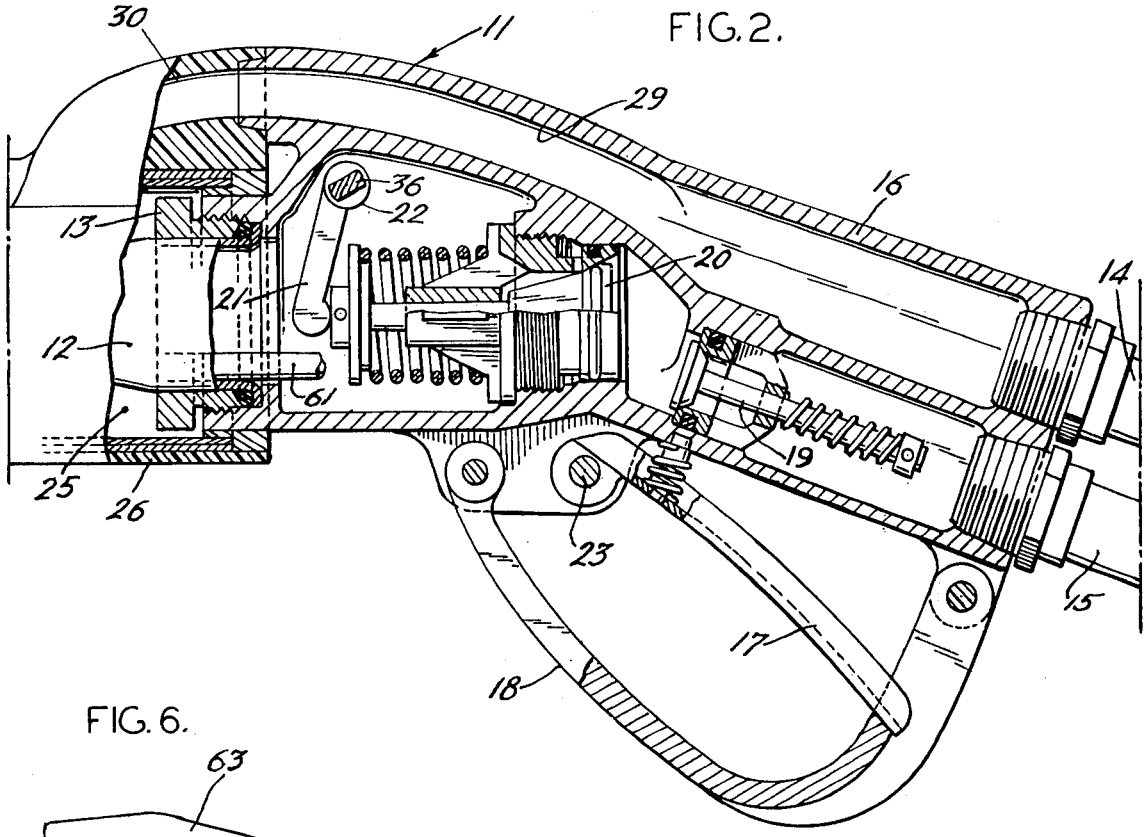
FIG. 2 is a partial sectional view taken through the dispensing nozzle of FIG. 1, illustrating the nozzle valve and fluid passages.

Referring to FIGS. 1 and 2, the basic nozzle and vapor receiving components, other than the nozzle control system components, will be briefly discussed. The nozzle assembly has a housing 11 with a discharge spout 12 connected thereto by retaining nut 13. A vapor return hose 14 and a gasoline supply hose 15 are connected to handle portion 16 of nozzle housing 11. Actuating lever 17 is provided to control dispensing of gasoline through the nozzle. Guard 18 acts to protect actuating lever 17 as well as to provide a support for holding the nozzle when it is inserted into the pump housing for storage when not in use.

Inside housing 11 is a gasoline flow passageway connected to gasoline supply hose 15, in which is included anti-drain valve 19 and nozzle valve 20 for controlling the flow of gasoline through the nozzle. Nozzle valve 20 is opened when operating arm 21 on valve shaft 22 is rotated toward nozzle valve 20. Valve shaft 22 is connected to actuator shaft 23 of lever 17 through a nozzle control system which is located behind cover 24 and will be explained in more detail below.

The vapor receiving system has a vapor receiving chamber, generally denoted by the numeral 25, which is formed by a non-flexible housing 26 mounted to nozzle housing 11 on one end, flexible bellows section 27 mounted on the other end of non-flexible housing 26, and a sealing section 28 connected to the free end of bellows 27, for making a tight seal against the fillpipe opening. A vapor return line for vapor receiving chamber 25 includes internal passageway 29 inside nozzle housing 11 connected to non-flexible housing 26 and vapor return hose 14 leading to the underground storage tanks or other container for collecting the vapors. An attitude valve, such as that identified by the numeral 30 in FIG. 2, can be provided at the connection of internal passageway 29 to non-flexible housing 26, so that the vapor return line is closed when the nozzle is not in use to prevent vapors from being displaced from the underground tanks back out into the atmosphere through the vapor receiving system. One attitude valve design which will perform this function is illustrated and discussed in the copending patent application entitled "Attitude Valve For A Gasoline Dispensing Nozzle With A Vapor Receiving System," by Hansel, Ser. No. 609,761, filed Sept. 2, 1975.

The locking system for the control system of the nozzle is designed primarily to operate on those control systems having an autaomtic shut-off system employing at least one diaphragm which separates two chambers of different pressures in which the movement of the diaphragm a predetermined distance causes the nozzle valve actuation system to be disabled so the gasoline can no longer flow through the nozzle. However, it is understood that the principles of operation behind these locking systems may be equally applicable in other nozzle control systems utilizing a different automatic shut-off system.

The structure of the nozzle valve actuation system for the nozzle control system will now be discussed with reference to FIGS. 3–7. Valve shaft 22 extends outwardly (laterally) from the arm 21, through a bore 33 formed in wall 32 of housing 11. A sleeve bearing is provided for shaft 22 by means of a bushing 34 which surrounds this shaft, within bore 33. A seal is provided for valve shaft 22 by means of 0-ring 35 which surrounds this shaft and engages the wall of bore 33, near the outer end of wall 32. This arrangement seals rotatable valve shaft 22 through wall 32 of nozzle housing 11 and prevents leakage of gasoline out of this housing.

Valve shaft 22 extends outwardly (sideways or laterally, in the normal upright position of the nozzle) beyond O-ring 35 and beyond the outer end of wall 32 a suitable distance. The outer end of this shaft (opposite to the inner end thereof, to which end arm 21 is fastened, as previously described) is provided with a tang 36. A valve arm 37, which extends generally in a direction at right angles to the axis of shaft 22, has at one end thereof an integral hub 38 having a substantially rectangular opening which fits over tang 36; this fastens valve arm 37 to shaft 22 so that rotation of valve arm 37 will rotate valve shaft 21 opening or closing valve 20. Valve arm 37 is somewhat banjo-shaped, having a large substantially central opening 39, and at its other end (opposite to hub 38) has an integral pin 40 which extends outwardly from the plane of the main portion of the arm.

A rocker arm 41, which is shown to be considerably thicker than valve arm 37, has at one end an elongated slot 42 which receives the outwardly-extending portion of pin 40, to provide a pin-and-slot pivotal connection between valve arm 37 and rocker arm 41. Rocker arm 41 has a substantially central circular hole 43 for receiving a fulcrum pin 58 (to be later described), and has at its other end an elongated slot 44 which receives the inwardly-extending portion of an outstanding pin 45 which is integrally located at one end of actuator arm 46. This latter arm provides a pin-and-slot pivotal connection between rocker arm 41 and actuator arm 46.

Actuator arm 46 lies substantially parallel to valve arm 37 (and also to rocker arm 41). At the end of arm 46, opposite to pin 45, is an integral hub 47 with a substantially rectangular opening which fits over a tang 48 provided on one end of actuator shaft 23.

Operation of the nozzle actuation system is accomplished by moving actuator arm 17 toward handle 16, which causes actuator arm 46 to rotate in a counterclockwise direction with respect to actuator shaft 23. The pin and slot pivotal connection at pin 45 causes rocker arm 41 to be pivoted in a counterclockwise position about fulcrum pin 58. Valve arm 37 is then rotated in a counterclockwise direction with respect to shaft 22 due to the pin and slot connection at pin 40. Rotation of valve shaft 22 in the counterclockwise direction causes operating arm 21 to be rotated towards nozzle valve 20, thereby causing it to open.

An automatic shut-off system, which is responsive to the presence of liquid gasoline reaching the end of the discharge spout, is also provided as part of the nozzle control system. The automatic shut-off system is designed to disable the valve actuating system by the movement of fulcrum pin 58 into and out of hole 43 in rocker arm 41. When fulcrum pin 58 is in the position illustrated in FIG. 4, it can act as a fulcrum point for the rotation of rocker arm 41. However, when fulcrum pin 58 is in its disabling position, as illustrated in FIG. 5, rocker arm 41 does not have a fulcrum point about which to pivot and therefore cannot rotate to move valve arm 37, despite the movement of actuating lever 17. In this disabling position, the spring in nozzle valve 20 causes valve 20 to remain closed, so that no gasoline is dispensed.

The automatic shut-off system will now be described in more detail, referring to FIG. 4. The side wall 32 of housing 11 has an outwardly-facing annular shoulder 50 which supports the outer ends of the three legs of a three-legged leaf spring 51. Spring 51 is generally Y-shaped, having three legs extending radially outwardly from a central hub area. Spring 51 is normally bowed slightly outwardly at its center (or upwardly as shown in FIG. 4).

Side wall 32 of the casing also has an outwardly-facing annular shoulder 52 (of larger diameter than shoulder 50) for mounting the outer periphery of a flexible impervious diaphragm 53. Diaphragm 53 is made from a suitable material (for example, Neoprene) which is substantially unaffected by gasoline. Diaphragm 53 is sealingly held in position against shoulder 52 by means of a diaphragm mounting or clamping plate 54 a portion of which overlies the outer edge of the diaphragm and which is secured to wall 32 by means of four bolts 55 (see FIG. 3), located beyond the edge of the diaphragm. Between the inner face of the diaphragm 53 and the inner partition which closes off the space within wall 32 there is thus formed an enclosed space or chamber 56 (actually, a volume) which may be termed a low pressure chamber. Clamping plate 54 has apertures spaced around its center so that a reference or high pressure chamber 57 is defined as the space between the outer face of diaphragm 53 and the inside of cover 24.

An outwardly-projecting fulcrum pin 58, whose outer end is normally positioned within hole 43 in the rocker arm 41, is attached to diaphragm 53, for movement thereby, by means of a bolt 59 which passes sealingly through a central hole in diaphragm 53 and which threads into a tapped hole in fulcrum pin 58. The head at the inner end of bolt 59 bears against the central hub area of spring 51. The fulcrum pin 58 is mounted for sliding movement (in the direction of its length) in a rigid support (capable of resisting lateral forces) provided by a sleeve 60 integral with a fixed diaphragm mounting plate 54.

As can be seen from this description, two pressure chambers are provided on either side of the diaphragm 53 which are identified as low pressure chamber 56 and reference pressure chamber 57 in FIG. 4. Reference chamber 57 can be allowed to remain at atmospheric pressure. However, because of the increased pressure in a tank being filled with a nozzle having a vapor recovery system, reference chamber 57 is connected to the vapor return line to provide a more reliable operation when using a vapor receiving system. This particular problem and one solution is discussed in more detail in the copending patent application by Hansel, entitled "Automatic Dispensing Nozzle Adapted For Vapor Recovery," Ser. No. 568,841, filed May 10, 1974, now U.S. Pat. No. 3,946,773.

Low pressure chamber 56 is connected to a venturi arrangement which is included in the valve design of main poppet valve 20, by a passageway means (not shown). As is well known by those skilled in the art, the flow of gasoline through the venturi arrangement produces a vacuum of sufficient force to cause diaphragm 53 to be displaced into chamber 56. However, this vacuum force is normally relieved through a vent line 61 connected at one end to chamber 56 and at the other end to an outlet 62 at the end of discharge spout 12.

During normal operation of the nozzle, gasoline is pumped through nozzle valve 20 and the venturi therein, to create a vacuum in low pressure chamber 56, which is relieved through vent tube 61. When the liquid level of the tank being filled reaches outlet 62 of vent tube 61 in the end of spout 12, the relief of the vacuum in chamber 56 is prevented. The vacuum created causes fulcrum pin 58 and diaphragm 53 to be pulled toward the interior of chamber 56 (or in a downward direction as illustrated in FIG. 4). At this time, rocker arm 41 does not have a pivot point and permits valve arm 37 to return to its normal position due to the force of the spring in nozzle valve 20. Since the flow of gasoline through the nozzle has stopped, no vacuum is created in chamber 56 and spring 51 moves fulcrum pin 58 and diaphragm 53 back to its original position.

The problem that is encountered in using nozzles which operate on principles similar to those discussed above is that the force required to shut the nozzle off (the vacuum created by the venturi arrangement) must be created by the flow of gasoline through the nozzle. The problem inherent in this system is that when the gasoline tank becomes filled with gasoline, despite the fact that outlet 62 of the vent tube 91 is covered with gasoline, some gasoline can still be dispensed into the gasoline tank before a sufficient vacuum is developed for the shut-off mechanism to disable the nozzle valve actuation system.

Herein lies the problem to which this invention is directed. Continuous attempts by the operator to pump more gasoline into a tank that is already filled can result in displacing gasoline into the vapor receiving system and back into the vapor return lines. While it is possible that this can be done innocently, it is also possible that a pump operator can create a fraud on the customer by causing him to pay for more gasoline than he is actually receiving. While no system can be made foolproof to thwart an unscrupulous operator, the locking systems provided herein serve to discourage the operator from continually trying to pump gasoline into a tank after it is automatically shut off the first time.

THE LOCKING SYSTEMS

One embodiment of the locking system has a locking arm 63 which is pivoted on one end about locking shaft 64 and lies in a plane between and parallel to valve arm 37 and rocker arm 41. Sleeve 60 of clamping plate 54, through which fulcrum pin 58 passes, has an opening or slot 65 passing entirely through part of the side wall of sleeve 60, through which locking arm 63 can pass. Fulcrum pin 58 has a notched shoulder 66 located around the circumference of its outwardly facing or upper side, as illustrated in FIG. 4. Locking arm 63 is biased so that it normally rotates into slot 65 toward fulcrum pin 58 by biasing spring 67 connected to a part of side wall 32 of housing 11. A reset mechanism is provided for rotating locking arm 63 away from slot 65 which includes a knob 68 slidably mounted in cover 24 and connected to the nonpivoted end of locking arm 63.

Figure 6:
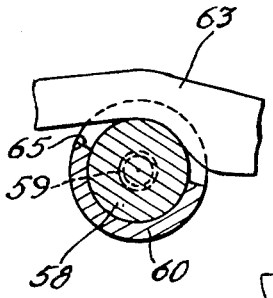
FIGS. 6 and 7 are partial sections of FIG. 5 taken along the line 6—6, illustrating the normal and locked positions of the locking system, respectively.
Figure 7:
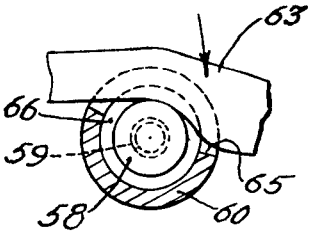
Figure 9:
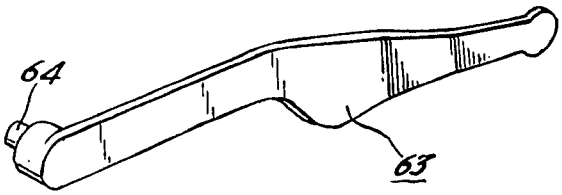
FIG. 9 is an elevational view of the locking arm.

In operation, since locking arm 63 is biased about locking shaft 64 toward fulcrum pin 58, locking arm 63 is pulled through slot 65 and onto shoulder 66 of fulcrum pin 58 when the vacuum force overcomes the force of spring 51 and pulls fulcrum pin 58 into sleeve 60, out of enagagement with rocker arm 41. The vacuum within chamber 56 is relieved once nozzle valve 20 closes, however, fulcrum pin 58 is prevented from returning to its original position in engagement with rocker arm 41 by the contact of locking plate 63 against shoulder 66, as is shown in FIGS. 5 and 7. At this time, further dispensing of gasoline is prevented since rocker arm 41 has no pivot point. In order to be able to dispense more gasoline, the operator must reset the locking mechanism by pulling knob 68 upward and away from nozzle valve control system cover 24. This action then permits spring 51 to return fulcrum in 58 back into its original position, and locking plate 63 again rests against the side of pin 58, as shown in FIGS. 4 and 6.

For purposes of minimizing the effect of the locking system on the normal operation of the nozzle systems, it is desirable to arrange the relationship between locking plate 63 and pin 58 so that the frictional force exerted on pin 58 by plate 63 does not greatly increase the vacuum force required to displace diaphragm 53 and pin 58. One method of accomplishing this result is to keep the surface area of locking plate 63 resting on pin 58 to a minimum. An additional feature is to have plate 63 resting on a beveled portion of pin 63 as opposed to the lateral side of pin 63, as is shown in FIG. 4. This particular placement of plate 63 acts to divide the force exerted by plate 63 and spring 67 so that the radial force on pin 63 is reduced.

Other variations on the locking system are possible to provide the same function. One alternative to the locking plate embodiment is illustated in FIGS. 10 and 11. This embodiment utilizes magnetic means to maintain the automatic shut-off system in its disabling position.

Figure 10:
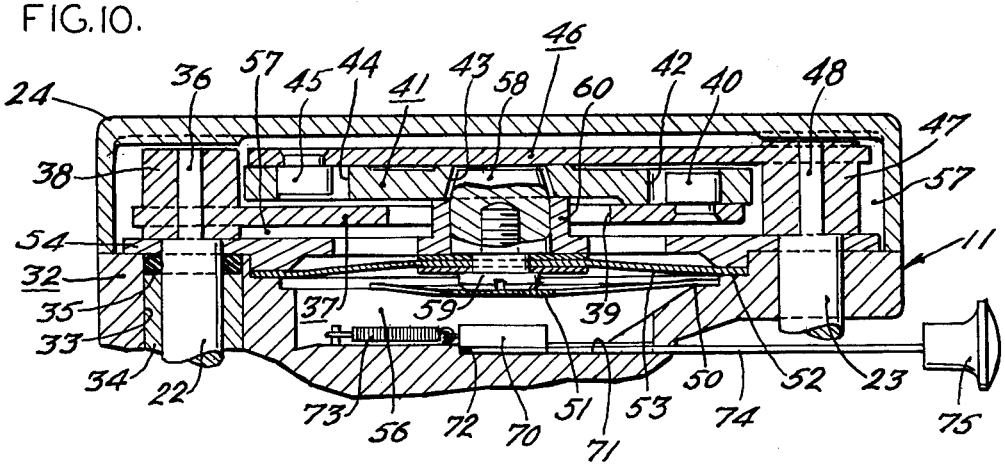
FIG. 10 is a sectional view similar to FIG. 4, showing the alternative embodiment in schematic form.
Figure 11:
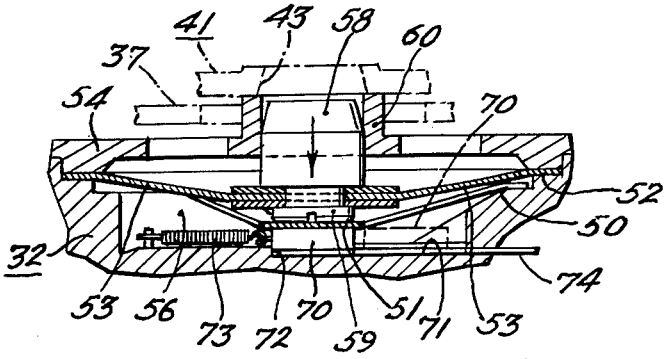
FIGS. 11 is a partial view of FIG. 10, illustrating the locking system in its locking position.

In this alternative embodiment, a magnet 70 is positioned beneath bolt 59 (as shown in FIG. 10), which secures fulcrum pin 58 to diaphragm 53. Bolt 59 is selected to be made from a ferrous material or other magnetically attractable material. The distance between magnet 70 and bolt 59 and the strength of magnet 70 are selected so that bolt 59 is not attracted to magnet 70 until the automatic shut-off system is actuated, moving bolt 59 against magnet 70, wherein the magnetic force of magnet 70 is sufficient to maintain diaphragm 53 and fulcrum pin 58 in their actuated positions.

A reset system to release bolt 59 can be designed in several ways. One system may include a mechanical means to push bolt 59 away from magnet 70. Another system, shown in FIG. 10, uses a means to displace magnet 70 away from bolt 59. In this system, magnet 70 is slidably mounted in a groove 71 with a stop 72 located so that when magnet 70 is positioned against the stop, it is correctly in place under bolt 59. Compression spring 73 is provided to normally bias magnet 70 against stop 72. Connecting link 74 extends out of chamber 56 to reset button 75 so that magnet 70 can be pulled away from bolt 59, as shown in phantom in FIG. 11, to permit the automatic shut-off system to return to its normal position.

As can be seen from this description of locking systems, the extra requirement of resetting the nozzle valve control system by unlocking the automatic shut-off system acts to remind the operator not to overfill the tank. While this locking mechanism cannot absolutely prevent overfilling of a tank by an operator intent on doing so, it does inconvenience the operator a sufficient amount to deter most operators from trying to overfill the tank.

THE RESET ACTUATOR

A programmable reset actuator is provided as an alternative to the reset systems discussed above to eliminate the problem of repeated resetting of the locking system by the operator. In accordance with the preferred embodiment of the reset actuator, resetting of the locking system will be permitted only a predetermined number of times, after which the nozzle will have to be removed from the fillpipe and placed in an upward position to reactivate the actuator (such as by placing the nozzle into the pump housing for storage).

Figure 12:
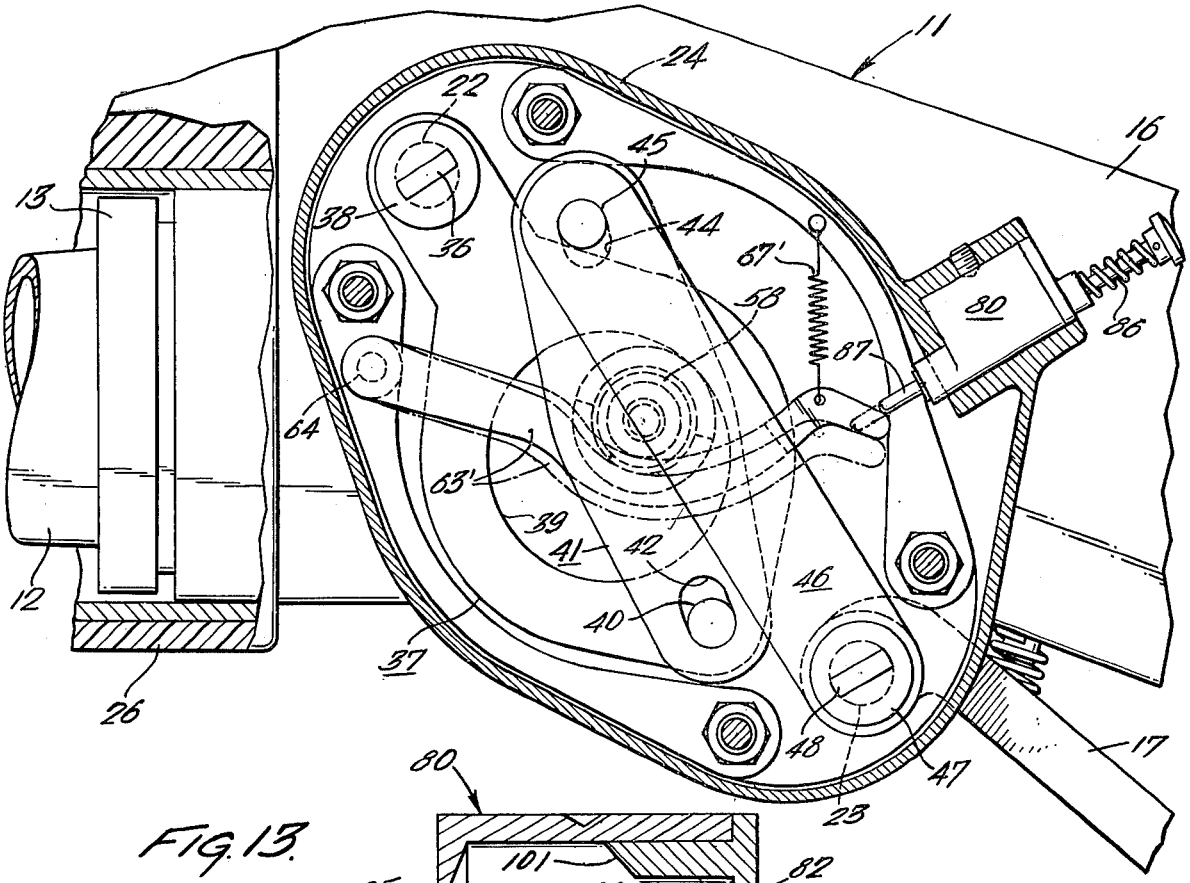
FIG. 12 is a sectional view similar to that shown in FIG. 3 showing the nozzle control system with the locking system (in a slightly altered form) in conjunction with the reset actuator.

The preferred embodiment of the reset actuator is designed to operate on a pushing motion toward the nozzle body, instead of a pulling motion as is required for knob 68, discussed above. This fact necessitates the positioning of locking plate 63 on the opposite side of fulcrum pin 58, as is illustrated in FIG. 12, wherein the modified locking plate and associated spring are identified by the numerals 63' and 67' rspectively. The relative position of reset actuator 80 with respect to the nozzle control system and locking plate 63' is illustrated in FIG. 12.

Figure 13:
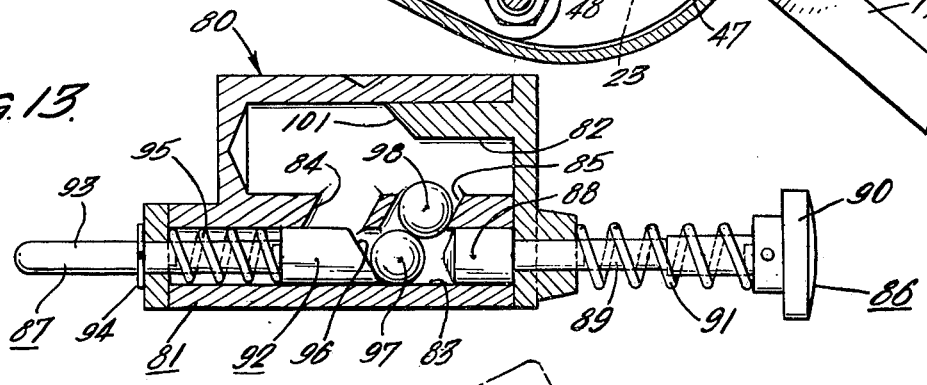
FIG. 13 is a sectional view of the reset actuator.

Referring to FIG. 13, reset actuator 80 has an actuator housing 81 with two essentially parallel, longitudinal passages, reservoir passage 82 and driving passage 83, which are connected by two essentially parallel, angled channels, entry channel 84 and return channel 85. The relative diameters of the passages and channels are approximately the same, this diameter being slightly greater than that of the balls enclosed therein to facilitate their movement as will be discussed below.

The driving element 86 and the driven element 87 are slidably mounted at opposite ends of driving passage 83. Driving element 86 includes driving piston 88, located in driving passage 83, and piston rod 89 extending from piston 88 out of housing 81, terminating at pushbutton 90. Coil spring 91 serves to bias driving element 86 to the right, as shown in FIG. 13, so that piston 88 is against the end of driving passage 83, and also is designed to restrict the amount element 86 can be displaced toward driven element 87 when completely compressed. An enlarged shoulder **89*a* on piston rod 89 also serves limit the travel of driving element 86**.

Driven element 87 includes driven piston 92 having piston arm 93 extending out of housing 81, the end of which contacts locking plate 63'. Restraining clip 94 restricts the inward movement of element 87, which is biased to move inward by spring 95, so that piston 92 remains under entry channel 84 in its normal position to prevent the return of any balls into passageway 83 at this location. Preferably, the head 96 of piston 92 is slanted slightly for reasons which will become apparent later. Piston arm 93 can have a square shaped cross section which acts to maintain the slanted head of piston 92 in its proper alignment with respect to channel 84. However, even with a circular shaped cross section, proper alignment of piston 92 is achieved during such actuation stroke because of the force exerted on slanted head 96 each time a ball is displaced into entry channel 84.

The relative sizes of the particular elements of actuator 80, shown in FIGS. 13–19, are designed to use two balls to permit two reset operations. The basic function of actuator 80 is to permit driven element 87 to be displaced a predetermined distance (sufficient to unlock the locking system) upon displacement of driving element 86, only when a ball is inside passage 83, to transfer the motion of driving element 86 to driven element 87. After one displacement stroke of driving element 86, the ball in passage 83 is displaced out of the passage and later returns to passage 83 upon rotation of actuator housing 81 through a preset arc and back again.

Figure 14:
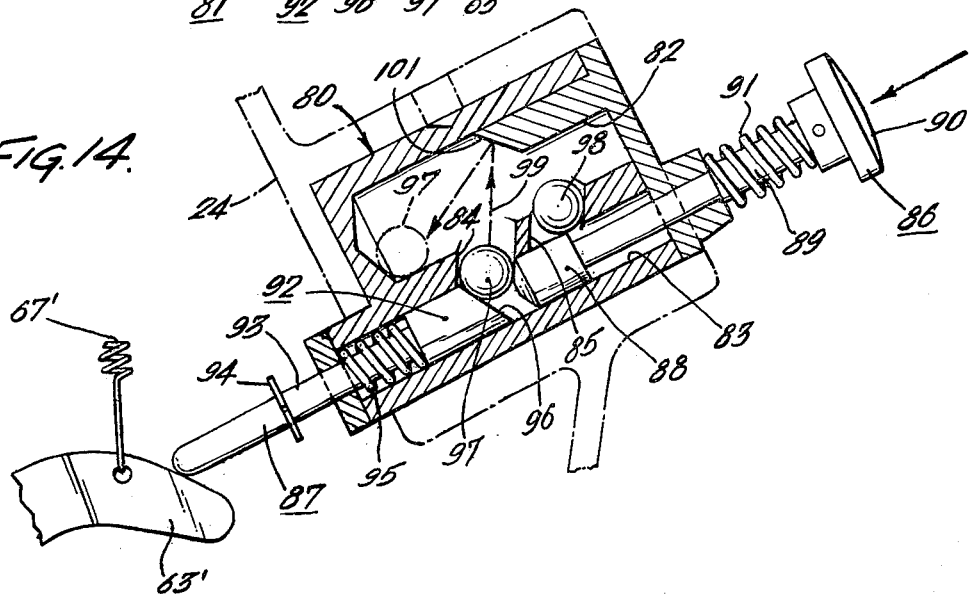
FIGS. 14–19 illustrate the various steps of operation for the reset actuator.
Figure 15:
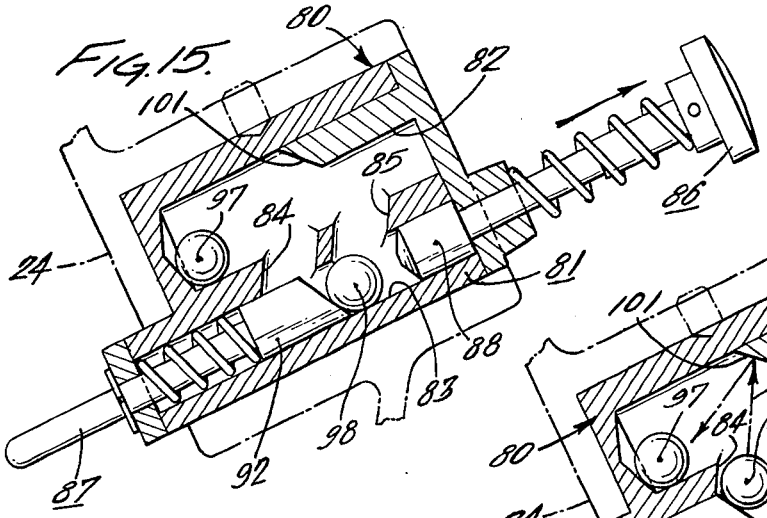
Figure 16:
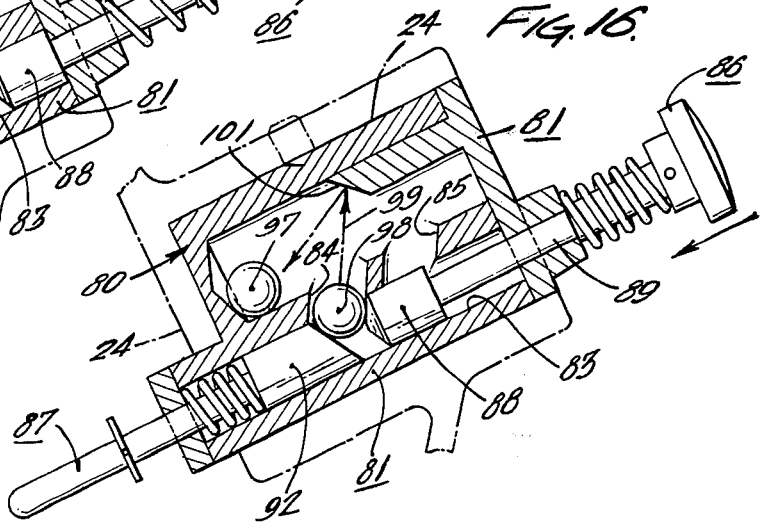

More specifically, referring to FIG. 14, when the nozzle is inserted into the fillpipe of a vehicle fuel tank, actuator housing 81 is slanted with the end containing driven element 87 being lower than the end having driving element 86. At this time, the locking system is still in its locked or disabling position from the previous filling operation (assuming the automatic shut-off system was used in the previous filling operation). Therefore, to initiate dispensing of gasoline, locking plate 63' must be displaced away from pin 58 to permit operation of the nozzle. This process is accomplished by pushing button 90 of driving element 86, which in turn transmits this motion to driven element 87 through ball 97. After driven element 87 has been displaced a predetermined distance, the opening of channel 84 to drive passage 83 is no longer blocked by piston 92, and ball 97 is forced out of passage 83, through channel 84 (as indicated by arrow 99 in FIG. 14), and into reservoir passage 82 (as shown in FIG. 15) because of the force of driving element 86 in combination with slanted head 96 of piston 92. Driven element 87 returns to its normal position and ball 97 either remains in the lower end of reservoir 82 or falls back into channel 84. Since driven piston 92 covers the entrance to channel 84, ball 97 is unable to re-enter drive passage 83. The longitudinal displacement of driven element 87 has been sufficient to displace locking plate 63' away from fulcrum 58 to enable the nozzle to function properly.

To prevent ball 97 from being forced back to the top of reservoir passage 82 and returning to return channel 85, where it can be again used to produce a reset operation, the top surface of reservoir passage 82 has a deflecting surface 101 to deflect the balls entering reservoir passage 82 down to the lower end.

Figure 17:
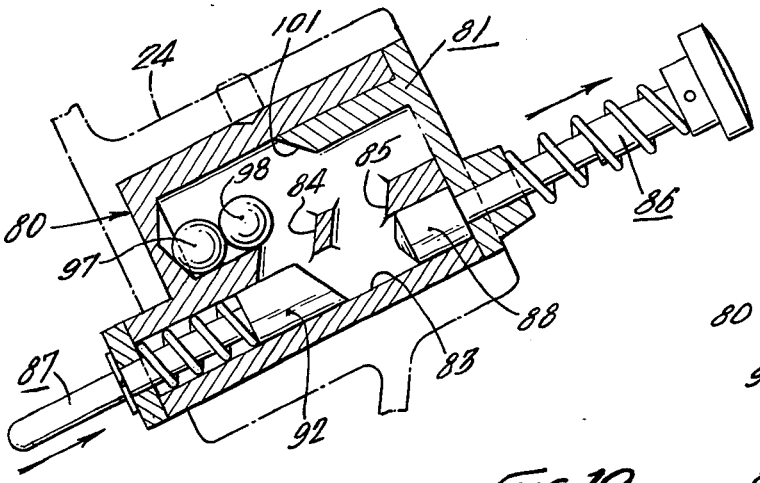

Normally, the operator would latch the nozzle so that it will dispense fuel at its highest speed. When the tank is nearly full, fuel will back up into the fillpipe causing the nozzle to automatically shut off. The locking system, as discussed above, acts to lock the automatic shut off system in its disabling position. To complete the filling operation, the locking mechanism is reset by again pressing button 90. This movement causes driven element 87 to be displaced by transfer of the motion through ball 98, which enters drive passage 83 when driving piston 88 returns to its normal position after the first reset operation. Ball 98 is displaced out of passage 83, through channel 84, against deflecting surface 101 (as shown by arrow 99 in FIG. 16), coming to rest in reservoir passage 82 (as shown in FIG. 17). Again, as discussed above for ball 97, driven element 87 is displaced a sufficient distance to reset the locking system. No further reset operation can be conducted at this time, due to the restictions imposed on the movements of driving element 86 and driven element 87 to prevent driving element 86 from contacting or moving driven element 87 unless a ball is located between them.

Figure 18:
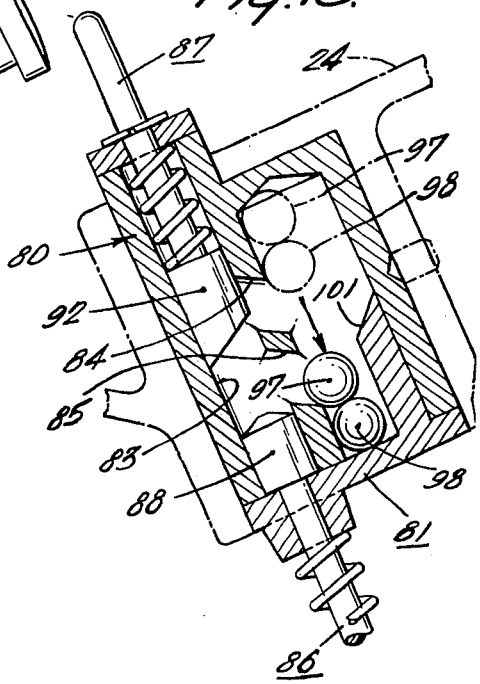
Figure 19:
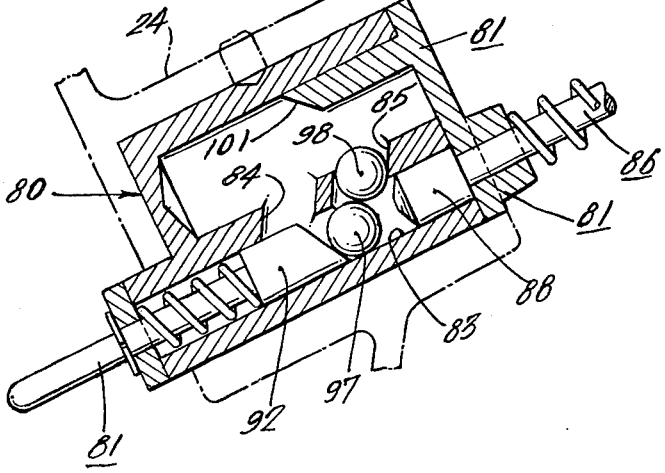

Once the nozzle automatically shuts off again, it cannot be operated until the nozzle is withdrawn from the fillpipe and placed in an upward direction, such as by storing it on the side of the pump housing. When this rotation of the nozzle takes place, actuator housing 81 is oriented as illustrated in FIG. 18, whereby balls 97 and 98 fall to the lower end of reservoir passage 82. Upon removal of the nozzle from the pump housing and rotation to its dispensing position, actuator housing 81 is again placed in its inclined position (see FIG. 19) wherein ball 97 returns to drive passage 83 to enable actuator 80 to perform its function of resetting the locking system, and ball 98 returns to channel 85 for use in the second resetting operation.

The particular embodiment discussed immediately above permits two reset operations to reset the locking system. Usually, one will be necessary to initiate dispensing of fuel. The second reset can be used at the end of the filling operation to enable the tank to be "topped off" at a low flowrate. However, should the previous customer not fill up his tank, the next operation of the nozzle will not require resetting of the locking system prior to its use. Instead, two reset operations will be available to "top off" the tank.

As can be appreciated from understanding the operation of this actuator, the relative dimensions of the elements of the actuator are important. The position of clip 94 on arm 93 of driven element 87 is chosen to permit piston 92 to retain a normal position wherein it covers the entrance of channel 84 to passage 83 a sufficient amount to prevent a ball from returning to passage 83 after it has entered channel 84. In addition, the length of passage 83 in relation to the longitudinal movement permitted by driving element 86 and driven element 87, and the location of channels 84 and 85 with respect to passage 83, should be such that driving element 86 cannot be pushed far enough to contact driven element 87 in its normal position, and driven element 87 can be displaced a sufficient distance to reset the locking mechanism only when a ball is between the two elements (86 and 87).

The operation of the actuator can be varied somewhat using a similar actuator structure. One variation is to use several more balls to provide more reset operations. This variation could be accommodated by merely increasing the length of channels 84 and 85, and reservoir passage 82.

Figure 20:
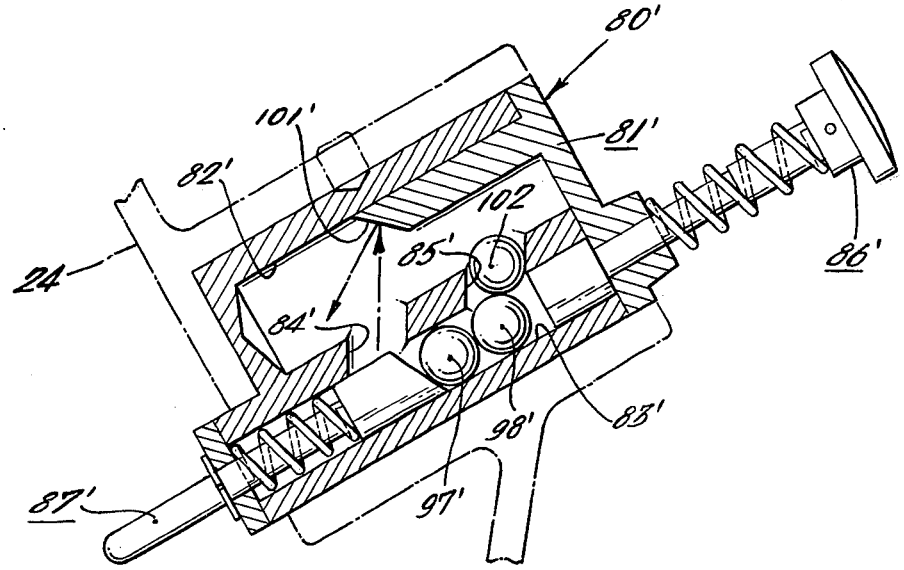
FIG. 20 illustrates an alternate embodiment of the reset actuator.

Another variation, which is illustrated in FIG. 20, with the same elements bearing the same number with prime designations, has a greater distance between channels 84 and 85. With this arrangement, an additional ball is placed in drive passage 83 and elements 86 and 87 are appropriately restricted so that the presence of two balls in passage 83 would be required before a reset operation could take place. In other words, when only one ball is in passage 83, the permitted travel of elements 86 and 87 is limited so that movement of driving element 86 fails to move driven element 87. The main advantage gained by using this embodiment is that it may be easier to fabricate housing 81 because of the increased size of the barrier between channels 84 and 85.

The same principle of operation for the above described reset actuator can be applied in different embodiments. One possible alternative embodiment (not shown) is to utilize two rotating discs which are connected by a ball to enable the driving disc to rotate the driven disc. Rotation of the discs through a predetermined arc would cause the ball to be ejected. Once the balls are all ejected, no more actuations would be permitted until the housing was rotated through a predetermined arc and back, thereby placing the balls into position for receipt by the discs.

While particular embodiments of this invention have been shown and described, it is obvious that changes and modifications can be made without departing from the true spirit and scope of the invention. It is the intention of the appended claims to cover all such changes and modifications.

The invention claimed is:

1. In a dispensing nozzle for filling a tank with a liquid where, when the tank becomes filled, the nozzle shuts itself off and an operator can reinitiate gasoline dispensing causing gasoline to be further pumped into the tank which can result in gasoline being pumped into a vapor receiving system, said nozzle being optionally in a storage position in a pump housing or in a dispensing position and having, a. a nozzle valve, b. means for actuating the nozzle valve into an open or closed position;

c. automatic shut-off means, responsive to the liquid in the tank reaching a predetermined level, for placing the actuating means in a disabled condition wherein the nozzle valve cannot be actuated, said shut-off means having an enabling mode wherein the actuating means can actuate the nozzle valve and a disabling mode wherein the actuating means cannot actuate the nozzle valve; and d. locking means, responsive to the automatic shut-off means obtaining its disabling mode, for locking the actuating means in the disabled condition so that the nozzle valve cannot be actuated by the actuating means, said locking means having the capability of being reset to its normal position by being displaced linearly, wherein the actuating means and automatic shut-off means can function in their normal manner;

the improvement which provides a locking system operating in conjunction with the gasoline dispensing nozzle to prevent, until reset, further dispensing of gasoline after the nozzle has automatically shut itself off comprising a reset actuator for resetting the locking means to its normal position wherein the actuating means can actuate the nozzle valve to permit further dispensing of liquid until the automatic shut-off means and the locking means is actuated again, and wherein a predetermined number of reset operations by said reset actuator is permitted, after which movement of the nozzle to a position for storage in a pump housing and back to the position for dispensing is required to permit another series of reset operations, said reset actuator comprising in combination:

e. a driving element, said driving element having a first position and a second position;

f. a driven element having a first position and a second position, said driven element communicating with the locking means so that when the driven element is in its first position, the locking is in its locked position, and when the driven element is in its second position, the locking means is moved into an unlocked position;

g. at least one motion transferring means for transferring the motion of the driving element to the driven element so that the movement of the driving element from its first position to its second position achieves a corresponding movement of the driven element from its first position to its second position; only when said motion transferring means is in communication with the driving and driven elements to provide a reset operation;

h. means cooperating with said driving and driven elements for removing the motion transferring means from communication with the driving and driven elements when the driven element reaches its second position; and i. means, responsive to the movement of the reset actuator through a predetermined arc and back to its original storage position for dispensing, for placing the motion transferring means into communication with the driving and driven elements, so that a corresponding movement of the driven element takes place in response to movement of the driving element to its second position to reset the locking means.

2. The reset actuator recited in claim 1, wherein the actuator further comprises:

a. means for biasing the driving element in its first position; and b. means for biasing the driven element in its first position.

3. The reset actuator recited in claim 2, wherein a predetermined number of individual motion transferring means is provided, and the placing means further comprises:

a. means for receiving each motion transferring means after removal from communication with the driving and driven elements by the removing means;

b. reservoir means for storing the individual motion transferring means so that after one motion transferring means is removed by the removing means, another motion transfer means is inserted into communication with the driving and driven elements when the driving element returns to its first position, thereby permitting another reset operation to take place;

c. passageway means arranged so that upon movement of the reset actuator through the predetermined arc to its storage position, the motion transferring means moves from the receiving means to the reservoir means, and so that upon a return movement of the reset actuator back to its original position, each motion transferring means moves into position to enable each motion transferring means to be individually placed in communication with the driving and driven element to enable the driven means to be moved in response to the driving means, thereby permitting a predetermined number of reset operations, the number being related to the number of motion transferring means provided.

4. In a dispensing nozzle for filling a tank with a liquid where, when the tank becomes filled, the dispensing nozzle automatically shuts itself off and an operator can initiate gasoline dispensing causing gasoline to be further pumped into the tank which can result in gasoline being pumped into a vapor receiving system, said nozzle having a storage position in a housing or a dispensing position and having, a. a nozzle valve, b. means for actuating the nozzle valve into an open or closed position;

c. automatic shut-off means, responsive to the liquid in the tank reaching a predetermined level, for placing the actuating means in a disabled condition wherein the nozzle valve cannot be actuated, said shut-off means having an enabling mode wherein the actuating means can actuate the nozzle valve and a disabling mode wherein the actuating means cannot actuate the nozzle valve; and d. locking means, responsive to the automatic shut-off means obtaining its disabling mode, for locking the actuating means in the disabled condition so that the nozzle valve cannot be actuated by the actuating means, said locking means having the capability of being reset to its normal position by being displaced linearly, wherein the actuating means and automatic shut-off means can function in their normal manner, the improvement which provides a locking system operating in conjunction with the gasoline dispensing nozzle to prevent, until reset, further dispensing of gasoline after the nozzle has automatically shut itself off comprising a reset actuator for resetting the locking means to its normal position wherein the actuating means can actuate the nozzle valve to permit further dispensing of liquid until the automatic shut-off means and the locking means is actuated again, and wherein a predetermined number of reset operations by said reset actuator is permitted, after which movement of the nozzle to a position for storage in a pump housing and back to the position for dispensing is required to permit another series of reset operations, said reset actuator comprising in combination:

e. a reset actuator housing mounted on the nozzle and having an elongated drive passage therein;

f. a driving element slidably mounted in the housing drive passage and having a rod extending outside said housing and terminating in a button so that the driving element can be manually displaced within the drive passage from a first position to a second position;

g. a driven element slidably mounted in the housing drive passage and having an arm extending outside the housing for communication with the locking means so that movement of the driven element and arm away from the housing a predetermined amount, from a first position to a second position, acts to reset the locking means;

h. means for restricting the movement of the driving and the driven elements in the drive passage so that the driving element cannot be moved to directly contact the driven element;

i. at least one ball as motion transferring means located between the driving and driven elements, so that movement of the driving element from its first position to its second position causes the driven element to be displaced the predetermined distance sufficient to reset the locking means;

j. means cooperative with the drive passage for removing a ball from the drive passage after the driven element has been displaced the predetermined distance from its first position to its second position; and k. means for returning the ball to the drive passage in response to rotation of the actuator housing through a predetermined arc to its storage position and then back to the position for the filling operation, whereby no more reset operations will be permitted after the ball has been removed from the drive passage and until the nozzle is rotated through the arc and returned to its position for the dispensing.

5. The reset actuator recited in claim 4, wherein the actuator further comprises:

a. means for biasing the driving element to normally remain in its first position; and b. means for biasing the driven element to normally remain in its first position.

6. The reset actuator recited in claim 5, wherein a predetermined number of balls is provided in the actuator, and the returning means comprises:

a. means for receiving each ball after removal from the drive passage by the removing means;

b. reservoir means for storing the balls so that after one ball is removed from the drive passage, another ball enters the drive passage when the driving element returns to its first position, until all of the balls enter the drive passage and are each removed to the receiving means; and c. passageway means arranged so that upon movement of the nozzle and actuator housing from the dispensing position for the nozzle, through a predetermined arc, the balls move from the receiving means to the reservoir means, and so that upon a return movement of the nozzle and actuator housing through said predetermined arc, back to the dispensing position for the nozzle, each ball can individually enter the drive passage to permit a reset of the locking means for each ball, the number of reset operations being related to the number of balls in the reservoir means.

7. In a dispensing nozzle for filling a tank with a liquid where, when the tank becomes filled, the dispensing nozzle automatically shuts itself off and an operator can initiate gasoline dispensing causing gasoline to be further pumped into the tank which can result in gasoline being pumped into a vapor receiving system, said nozzle being in a storage position or in a dispensing position and having, a. a nozzle valve, b. means for actuating the nozzle valve into an open or a closed position;

c. automatic shut-off means, responsive to the liquid in the tank reaching a predetermined level, for placing the actuating means in a disabled condition wherein the nozzle valve cannot be actuated, said shut-off means having an enabling mode wherein the actuating means can actuate the nozzle valve and a disabling mode wherein the actuating means cannot actuate the nozzle valve; and d. locking means, responsive to the automatic shut-off means obtaining its disabling mode, for locking the actuating means in the disabled condition so that the nozzle valve cannot be actuated by the actuating means, said locking means having the capability of being reset to its normal position by being displaced linearly, wherein the actuating means and automatic shut-off means can function in their normal manner, the improvement which provides a locking system operating in conjunction with the gasoline dispensing nozzle to prevent, until reset, further dispensing of gasoline after the nozzle has automatically shut itself off comprising a reset actuator for resetting the locking means to its normal position wherein the actuating means can actuate the nozzle valve to permit further dispensing of liquid until the automatic shut-off means and the locking means is actuated again, and wherein a predetermined number of reset operations by said reset actuator is permitted, after which movement of the nozzle to a position for storage in a pump housing and back to the position for dispensing is required to permit another series of reset operations, said reset actuator comprising in combination:

e. a reset actuator housing mounted on the nozzle and having therein, i. an elongated drive passage, disposed within the actuator housing so that when the nozzle is in its dispensing position, a first end of the drive passage is lower than the other or second end, and when the nozzle is placed in an upward position, the first end of the drive passage becomes higher than the second end, ii. an elongated reservoir passage disposed essentially parallel to and essentially in the same vertical plane as the drive passage when the nozzle is placed in position for dispensing, and iii. two essentially parallel channels, each connecting the drive passage and the reservoir passage, with the reservoir entry channel being located near the first end of the drive passage, and with the drive passage return channel being located near the second end of the drive passage;

f. a driving element slidably mounted in the housing drive passage, and having a piston section in the drive passage and a rod extending from the piston section outside said housing and terminating in a button so that said driving element can be manually displaced within the drive passage, said driving element having a first position wherein the piston section is in the second end of the drive passage and does not cover the junction of the return channel and the drive passage, and a second position wherein the piston covers the return channel and drive passage junction.

g. a driven element slidably mounted in the housing drive passage, and having a piston section in the drive passage and an arm extending from the piston section, outside the housing for communication with the locking means, said driven element having a first position wherein its piston section essentially covers the junction of the entry channel with the drive passage, without reaching the location of the piston section of the driving element if the driving element should be in its second position, and having a second position wherein the junction of the entry channel and the drive passage is uncovered and its piston section is in the first end of the drive passage, the predetermined distance between the first and second position being sufficient to reset the locking means when the driven element reaches its second position;

h. means for restricting the movement of the driving and the driven elements in the drive passage so that the driving element cannot be moved to directly contact the driven element; and i. at least one ball as motion transferring means located between the driving and driven elements, so that movement of the driving element from its first position to its second position causes the driven element to be displaced the predetermined distance sufficient to reset the locking means, after which the ball enters the entry channel, wherein it is no longer in the drive passage and no further reset operations are possible until the nozzle is rotated from its dispensing position to its storage position and back again to its dispensing position, whereby the ball returns to the drive passage through the reservoir passage and the return channel.

8. The reset actuator recited in claim 7, wherein the actuator further comprises:

a. means for biasing the driving element to normally remain in its first position; and b. means for biasing the driven element to normally remain in its first position.

9. The reset actuator recited in claim 8, wherein a predetermined number of balls are contained in the actuator housing so that a predetermined number of reset operations, related to the number of balls, are permitted until all the balls are individually displaced from drive passage, to the entry passage after each reset operation, after which the predetermined number of reset operations can again be conducted when the nozzle is rotated from its position for dispensing, to its position for storage, and back to its dispensing position, wherein the balls return to the return channel, through the reservoir channel.

10. The reset actuator recited in claim 9, wherein the entry channel and return channels are disposed in a vertical direction when the nozzle and the actuator housing are in position for dispensing.

11. The reset actuator recited in claim 10, wherein the end of the piston section of the driven element, which contacts the balls in the drive passage, has a slanted face for directing the ball into the entry channel.

12. The reset actuator recited in claim 11, wherein the reservoir passage has means for preventing the balls forced from the drive passage, from entering the return channel until the nozzle is rotated from its dispensing position, to its storage position, and back to its dispensing position again, so that the same ball is not reused in a series of reset operations.

13. The reset actuator recited in claim 12, wherein the preventing means comprises means, located in the reservoir passage opposite the entry channel and reservoir passage junction, for deflecting the balls toward the lower end of the reservoir passage, when the nozzle is in its dispensing position.

14. A programable actuator for a dispensing nozzle for filling a tank with liquid which provides a locking system operating in conjunction with the gasoline dispensing nozzle to prevent further dispensing of gasoline after the nozzle has automatically shut itself off by producing an output actuating motion in response to an input motion, said actuator designed to limit the output motions to a predetermined number for each series of actuations, after which no more output motions in response to an input motion are possible until the actuator is rotated through a predetermined arc and back to its original position so that a new series of output actuating motions are permitted, said acuator comprising in combination:

a. an actuator housing;

b. a driving element mounted in the housing so that it can be manually moved from a first position to a second position;

c. a driven element movably mounted in the housing and having a first and second position, wherein movement from the first to the second position provides the actuator output actuating motion, said driven element also being mounted in the housing so that regardless of its position, no direct physical contact with the driving means is possible.

d. at least one means for transferring the motion of the driving element to the driven element so that the movement of the driving element form its first position to its second position achieves a corresponding movement of the driven element from its first to its second position, thereby producing an output actuating motion, only when said motion transferring means is in communication with the driving and driven elements;

e. means for removing the motion transferring means out of communication with the driving and driven element when the driven element reaches its second position; and f. means, responsive to the movement of the actuator housing through a predetermined arc and back to its original position, for placing the motion transferring means into communication with the driving and driven elements, so that another output actuating motion can be produced.

15. The programable actuator recited in claim 4, wherein the actuator further comprises:

a. means for biasing the driving element in its first position; and b. means for biasing the driven element in its first position.

16. The programable actuator recited in claim 15, wherein a predetermined number of individual motion transferring means is provided, and the placing means further comprises:

a. means for receiving each motion transferring means after removal from communication with the driving and driven elements by the removing means;

b. reservoir means for storing the individual motion transferring means so that after one motion transferring means is removed by the removing means, another motion transfer means is inserted into communication with the driving and driven elements when the driving element returns to its first position, thereby permitting another output actuating motion to take place.

c. passageway means arranged so that upon movement of the actuator housing through the predetermined arc, the motion transferring means moves from the receiving means to the reservoir means, and so that upon a return movement of the reset actuator back to its original position, each motion transferring means moves into position to enable each motion transferring means to be individually placed in communication with the driving and driven element to enable the driven means to be moved in response to the driving means, thereby permitting a predetermined number of output actuating motions, the number being related to the number of motion transferring means provided.

17. A programable actuator for a dispensing nozzle for filling a tank with liquid which provides a locking system operating in conjunction with the gasoline dispensing nozzle to prevent further dispensing of gasoline after the nozzle has automatically shut itself off by producing an output actuating motion in response to an input motion, said actuator designed to limit the output motion to a predetermined number for each series of actuations, after which no more output motions in response to an input motion are possible until the actuator is rotated through a predetermined arc and back to its original position so that a new series of output actuating motions are permitted, said actuator comprising in combination:

a. an actuator housing having an elongated drive passage therein;

b. a driving element slidably mounted in the housing drive passage and having a rod extending outside said housing and terminating in a button so that the driving element can be manually displaced within the drive passage from a first position to a second position;

c. a driven element slidably mounted in the housing drive passage and having an arm extending outside the housing so that movement of the driven element and arm away from the housing a predetermined amount, from a first position to a second position, produces the output actuating motion;

d. means for restricting the movement of the driving and the driven elements in the drive passage so that the driving element cannot be moved to contact the driven element;

e. at least one ball having a size so that when located between the driving and driven elements, movement of the driving element from its first position to its second position causes the driven element to be displaced the predetermined distance sufficient to reset the locking means;

f. means for removing a ball from the drive passage after the driven element has been displaced the predetermined distance from its first position to its second position; and g. means for returning the ball to the drive passage in response to rotation of the actuator housing through a predetermined arc and then back to its original position, whereby no more output actuating motions will be permitted after the ball has been removed from the drive passage and until the housing is rotated through the arc and returned to its original position.

18. The programable actuator recited in claim 17, wherein the actuator further comprises:

a. means for biasing the driving element to normally remain in its first position; and b. means for biasing the driven element to normally remain in its first position.

19. The programable actuator recited in claim 18, wherein a predetermined number of balls is provided in the actuator, and the returning means comprises in combination:

a. means for receiving each ball after removal from the drive passage by the removing means;

b. reservoir means for storing the balls so that after one ball is removed from the drive passage, another ball enters the drive passage when the driving element returns to its first position, until all of the balls enter the drive passage and are each removed to the receiving means; and c. passageway means arranged so that upon movement of the nozzle and actuator housing from its original position, through a predetermined arc, the balls move from the receiving means to the reservoir means, and so that upon a return movement of the housing through said predetermined arc, back to its original position, each ball can individually enter the drive passage to permit an output actuating motion to be produced for each ball, the number of output actuating motions being related to the number of balls in the reservoir means.

20. A programable actuator for a dispensing nozzle for filling a tank with liquid which provides a locking system operating in conjunction with the gasoline dispensing nozzle to prevent further dispensing of gasoline after the nozzle has automatically shut itself off by producing an output actuating motion in response to an input motion, said actuator designed to limit the output motions to a predetermined number for each series of actuations, after which no more output motions in response to an input motion are possible until the actuator is rotated through a predetermined arc and back to its original position so that a new series of output actuating motions are permitted, said actuator comprising in combination:

a. a programable actuator housing having, i. an elongated drive passage, disposed within the actuator housing so that when the housing is in its original position, a first end of the drive passage is lower than the other or second end, and when the housing is placed in an upward position, the first end of the drive passage becomes higher than the second end, ii. an elongated reservoir passage disposed essentially parallel to and essentially in the same vertical plane as the drive passage when the housing is placed in its original position, and iii. two essentially parallel channels, each connecting the drive passage and the reservoir passage, with the reservoir entry channel being located near the first end of the drive passage, and with the drive passage return channel being located near the second end of the drive passage;

b. a driving element slidably mounted in the housing drive passage, and having a piston section in the drive passage and a rod extending from the piston section outside said housing and terminating in a button so that said driving element can be manually displaced within the drive passage, said driving element having a first position wherein the piston section is in the second end of the drive passage and does not cover the junction of the return channel and the drive passage, and a second position wherein the piston covers the return channel and drive passage junction;

c. a driven element slidably mounted in the housing drive passage, and having a piston section in the drive passage and an arm extending from the piston section, outside the housing, said driven element having a first position wherein its piston section essentially covers the junction of the entry channel with the drive passage, without reaching the location of the piston section of the driving element if the driving element should be in its second position, and having a second position wherein the junction of the entry channel and the drive passage is uncovered and its piston section is in the first end of the drive passage, the predetermined distance between the first and second position being sufficient to produce an output actuation motion when the drive element reaches its second position.

d. means for restricting the movement of the driving and the driven elements in the drive passage so that the driving element cannot be moved to contact the driven element, and e. at least one ball having a size so that when located between the driving and driven elements, movement of the driving element from its first position to its second position causes the driven element to be displaced the predtermined distance sufficient to produce an output actuating motion, after which the ball enters the entry channel, wherein it is no longer in the drive passage and no further reset operations are possible until the housing is rotated from its original position, through the predetermined arc, and back again to its original position, whereby the ball returns to the drive passage through the reservoir passage and the return channel.

21. The programable actuator recited in claim 20, wherein the actuator further comprises:

a. means for biasing the driving element to normally remain in its first position; and b. means for biasing the driven element to normally remain in its first position.

22. The programable actuator recited in claim 21, wherein a predetermined number of balls are contained in the actuator housing so that a predetermined number of output actuating motions, related to the number of balls, are permitted until all the balls are individually displaced from drive passage, to the entry passage after each output motion, after which the predetermined number of output actuating motions can again be produced when the housing is rotated from its original position, through the predetermined arc and back to its original position, so that the balls return to the return channel, through the reservoir channel.

23. The programable actuator recited in claim 22, wherein the entry channel and return channels are disposed in a vertical direction when the actuator housing is in its original position.

24. The programable actuator recited in claim 23, wherein the end of the piston section of the driven element, which contacts the balls in the drive passage, has a slanted face for directing the ball into the entry channel.

25. The programable actuator recited in claim 24, wherein the reservoir passage has means for preventing the balls forced from the drive passage, from entering the return channel until the nozzle is rotated through the predetermined arc, so that the same ball is not reused in a series of actuating motions.

26. The programable actuator recited in claim 25, wherein the preventing means comprises means, located in the reservoir passage opposite the entry channel and reservoir passage junction, for deflecting the balls toward the lower end of the reservoir passage, when the housing is in its original position.

* * * * *